US009845809B2

(12) United States Patent
Harrison

(10) Patent No.: US 9,845,809 B2
(45) Date of Patent: Dec. 19, 2017

(54) SEALING JOINT FOR A COMPRESSOR CASING

(71) Applicant: TRANE INTERNATIONAL INC., Piscataway, NJ (US)

(72) Inventor: Mark W. Harrison, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 14/413,163

(22) PCT Filed: Jul. 8, 2013

(86) PCT No.: PCT/US2013/049538

§ 371 (c)(1),
(2) Date: Jan. 6, 2015

(87) PCT Pub. No.: WO2014/008500

PCT Pub. Date: Jan. 9, 2014

(65) Prior Publication Data

US 2015/0198170 A1 Jul. 16, 2015

Related U.S. Application Data

(60) Provisional application No. 61/668,761, filed on Jul. 6, 2012.

(51) Int. Cl.
*F16J 15/02* (2006.01)
*F04D 29/08* (2006.01)
(Continued)

(52) U.S. Cl.
CPC ..... *F04D 29/083* (2013.01); *F01C 21/10* (2013.01); *F04C 27/008* (2013.01); *F04D 29/4206* (2013.01); *F04C 2240/805* (2013.01)

(58) Field of Classification Search
CPC ... F16J 15/0887; F01D 11/005; F04D 29/083; F04D 29/4206; F01C 21/10; F04C 27/008; F04C 2240/805
(Continued)

(56) References Cited

U.S. PATENT DOCUMENTS 2,926,937 A 3/1960 Parsons
3,191,949 A 6/1965 Lansky
(Continued)

FOREIGN PATENT DOCUMENTS

CN 101725524 6/2010
CN 201944260 U 8/2011
(Continued)

OTHER PUBLICATIONS

Loctite gasket flange sealant, accessed from http://na.henkel-adhesives.com on Mar. 30, 2016.*
(Continued)

*Primary Examiner* — Nathan Cumar
(74) *Attorney, Agent, or Firm* — Hamre, Schumann, Mueller & Larson, P.C.

(57) ABSTRACT

A sealing joint for a compressor casing, such as a compressor casing for a centrifugal compressor of a chiller, is provided. The sealing joint may be configured to have a first cover and a second cover. A first mating surface of the first cover may have an inner annular portion surrounding an inner cavity of the sealing joint, and an outer annular portion. The inner annular portion may be positioned between the inner cavity of the compressor casing and the outer annular portion. A sealant may be applied to the sealing joint, and a depth of the sealant on the inner annular portion may be deeper than a depth of the sealant on the outer annular portion. The depth of the sealant on the inner annular portion may help the sealing joint tolerate more
(Continued)

elongation range without a sealant failure than a regular casing.

11 Claims, 5 Drawing Sheets

(51) Int. Cl.
*F01C 21/10* (2006.01)
*F04C 27/00* (2006.01)
*F04D 29/42* (2006.01)

(58) Field of Classification Search
USPC ..... 277/643
See application file for complete search history.

(56) References Cited

U.S. PATENT DOCUMENTS 3,467,398 A 9/1969 Bernard
3,671,046 A 6/1972 Hagmann
4,155,561 A 5/1979 Rudy et al.
4,819,953 A 4/1989 Joh
4,830,383 A * 5/1989 Probst ..... F16J 15/14 277/316
5,275,420 A * 1/1994 Rodenkirch ..... F16J 15/14 277/313
6,722,666 B2 4/2004 Yokomachi et al.
7,708,281 B2 * 5/2010 West ..... 277/312
8,302,972 B2 * 11/2012 Anderberg ..... 277/608
2001/0050464 A1 12/2001 Kuramoto et al.
2002/0021004 A1 * 2/2002 Mitchell ..... F16L 23/003 285/15
2007/0007767 A1 1/2007 Howard
2007/0102926 A1 * 5/2007 Magnier ..... F16L 23/032 285/368
2012/0151915 A1 6/2012 Dullack et al.

FOREIGN PATENT DOCUMENTS

JP 2010/209750 9/2010
KR 20-0119536 7/1998

OTHER PUBLICATIONS

Loctite sealants-elongation b_w, accessed from http://na.henkel-adhesives.com on Mar. 30, 2016.*
sealant—definition by The Free Dictionary.*
Loctite sealants b_w, accessed via http://na.henkel-adhesive.com/industrial/.*
International Search Report and Written Opinion for International Application No. PCT/US2013/049538, dated Sep. 12, 2013, 10 pgs.

* cited by examiner

SEALING JOINT FOR A COMPRESSOR CASING

FIELD OF TECHNOLOGY

Embodiments disclosed herein relate generally to a compressor of a heating, ventilation and air conditioning (HVAC) system. More specifically, the embodiments disclosed herein relate to a sealing joint for a compressor casing, such as a casing for a centrifugal compressor of a chiller.

BACKGROUND

A HVAC system, for example a chiller with shell and tube heat exchangers, sometimes uses a centrifugal compressor. The centrifugal compressor generally includes a motor configured to drive one or more impellers, and the compressor may be housed in a compressor casing. During operation, refrigerant can be sucked into the compressor casing and compressed by a centrifugal force, thus creating a relatively high pressure inside the compressor casing. In some situations, the compressor casing may be configured to include two separate covers that are jointed together by a mounting mechanism, such as bolts and nuts so that the compressor casing can be opened, for example for service purposes.

SUMMARY

The embodiments disclosed herein relate to a sealing joint for a casing, such as a casing for a centrifugal compressor of a chiller.

In some embodiments, the sealing joint may include two covers that may be configured to withstand a pressure of compressed refrigerant and seal the refrigerant inside the compressor casing. In some embodiments, a sealant, such as a Loctite® anaerobic sealant may be applied to the sealing joint to form a sealant layer to help seal the refrigerant inside the compressor casing.

An interface of a sealing joint of a compressor subject to a pressure may separate due to the pressure or other applications, which may cause elongation of the sealant applied to the interface. When the elongation of the sealant layer exceeds a tolerable elongation range of the sealant layer, the sealant layer may fail, causing refrigerant leakage from the sealing joint.

In some embodiments, the sealing joint may be configured to include a first cover and a second cover, which has a first mating surface and a second mating surface respectively. In some embodiments, the first mating surface may be configured to have a first portion and a second portion. In some embodiments, the first portion and the second portion may be configured to form the sealing joint with the second mating surface. In some embodiments, the first cover and the second cover may be configured to be mounted together by a mounting mechanism, such as a plurality of bolts and/or nuts, etc.

In some embodiments, the first portion of the first mating surface is configured to accommodate the mounting mechanism. In some embodiments, the sealing joint has an inner cavity, and the second portion may be positioned between the inner cavity of the sealing joint and the first portion. In some embodiments, from a sectional view of the sealing joint, a step is formed between the first portion and the second portion.

In some embodiments, the first portion and the second portion of the sealing joint may be configured to receive a sealant. In some embodiments, a depth of the sealant layer disposed on the second portion may be deeper than a depth of the sealant layer disposed on the first portion.

In some embodiments, the first portion and the second portion are configured to encircle the entire inner cavity of the sealing joint.

Other features and aspects of the embodiments will become apparent by consideration of the following detailed description and accompanying drawings.

BRIEF DESCRIPTION OF THE DRAWINGS

FIG. 2A is a partial exploded sectional view of the sealing joint. FIG. 2B is a partial front view of an interface of the sealing joint. FIG. 2C is an enlarged view of an area 2C in FIG. 2A. FIG. 2D is a partial section view of the sealing joint.

FIG. 3A is a partial exploded sectional view of the sealing joint. FIG. 3B is a partial front view of an interface of the sealing joint.

DETAILED DESCRIPTION

Figure 1:
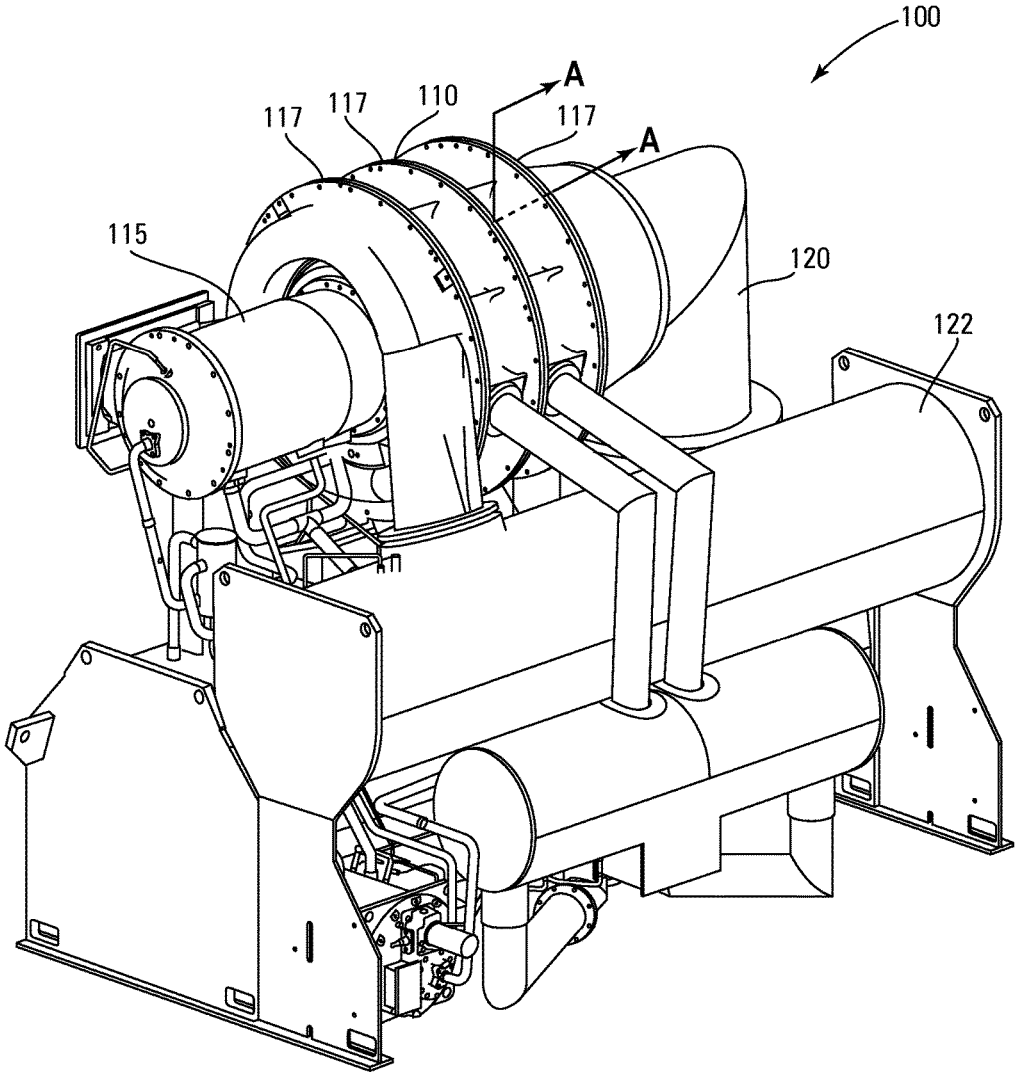
FIG. 1 is a perspective view of a chiller system with a multiple stage centrifugal compressor.

The embodiments disclosed herein relate to a sealing joint for a casing, such as a casing for a centrifugal compressor of a chiller.

In a HVAC system that utilizes a centrifugal compressor, an impeller(s) of the centrifugal compressor is often housed in a compressor casing. The compressor casing can be configured to withstand a pressure created by compressed refrigerant. The compressor casing can be configured to have two separate covers that meet to form a sealing joint. A sealant, such as Loctite® anaerobic sealant, can be applied to an interface of the sealing joint to create a seal to prevent leakage of refrigerant at the sealing joint.

During operation, the pressure inside the compressor casing sometimes can push the two covers apart at the sealing joint. Generally, the higher the pressure is, the further apart the two covers can be pushed, causing the sealant disposed on the interface to elongate. Since the sealant may generally have some flexibility, the sealant may be able to withstand some elongation created by the separation of the two covers under the pressure. However, when the separation of the two covers exceeds a tolerable elongation range of the sealant, the sealant may fail resulting in a leakage of refrigerant from the compressor casing. For example, when the compressor casing undergoes a factory pressure proof testing, the elevated pressure applied during the proof testing may separate the two covers apart beyond the tolerable elongation range of the sealant, causing the sealant to fail and thus the refrigerant to leak.

In addition, some refrigerants may require an elevated working pressure inside the compressor casing, which may cause the sealant to fail. For example, when a chiller system is retrofitted to work with a different refrigerant, the newly applied refrigerant may work at a higher pressure than the previous refrigerant. The sealant of the retrofitted compressor therefore may have to withstand the higher working pressure without causing refrigerant leakage.

Different sealants may have different predetermined tolerable elongation ranges. For example, based on the manufacturing recommendation, one of the Loctite® sealants has a tolerable elongation range of about 10% to 30% of a depth of the sealant layer. That is, the sealant layer may fail if the elongation of the sealant exceeds about 10 to 30% of the depth of the sealant layer applied to the interface of the joint. For example, in one application, the depth of the sealant layer applied on the interface of the sealing joint is about 0.001 inch. Based on the recommended tolerable elongation range of about 10 to 30% of the sealant layer's depth, the permitted elongation range can be set at about 20% of the depth of the sealant layer. For example, the sealant may fail under a pressure inside the compressor casing that can create a separation of the two covers exceeding about 0.0012 inch ((100%+20%)×0.001 inch of the depth) at the interface. Therefore if the compressor casing needs to withstand a higher pressure or reduce sealant failure rate under an elevated pressure, the applied depth of the sealant layer on the interface may have to be increased so as to increase the tolerable elongation range of the sealant on the interface. However, increasing the depth of the sealant layer applied on the interface may interfere with a hardening process of the sealant, i.e. the sealant may take longer to cure or may not cure at all without an accelerator. Using the accelerator may result in increased brittleness of the sealant, reducing the effectiveness of the sealant. For the Loctite® sealants described herein, the manufacturer recommends about 0.002 to 0.004 inch of the depth of the sealant layer.

A sealing joint of a compressor casing, such as a centrifugal compressor of a chiller, is described herein. The sealing joint may be configured to have a first cover and a second cover. A first mating surface of the first cover may have an inner annular portion surrounding an inner cavity of the sealing joint, and an outer annular portion. The inner annular portion may be positioned between the inner cavity of the compressor casing and the outer annular portion. The inner annular portion and the outer annular portion may be configured to receive a sealant, and a depth of the sealant layer disposed on the inner annular portion may be deeper than a depth of the sealant layer disposed on the outer annular portion. The depth of the sealant layer on the annular portion may allow the sealant to tolerate a certain degree of elongation without sealant failure.

References are made to the accompanying drawings that form a part hereof, and in which is shown by way of illustration of the embodiments in which the embodiments may be practiced. It is to be understood that the terms used herein are for the purpose of describing the figures and embodiments and should not be regarded as limiting the scope of the present application.

FIG. 1 illustrates a chiller 100 equipped with a multiple-stage centrifugal compressor 110. The compressor 110 includes a motor housing 115 accommodating a motor (not shown), and casings 117 accommodating one or more impellers (not shown) of the compressor 110. During operation, a refrigerant (usually a refrigerant in a vapor state) can be sucked into the casings 117 through a suction line 120, compressed by the impellers and then directed toward a condenser 122. Since the refrigerant is compressed in the casings 117, the casings 117 may be subject to a relatively high pressure, such as, for example, about 50 psig (pound-force per square inch gauge).

Figure 2A:
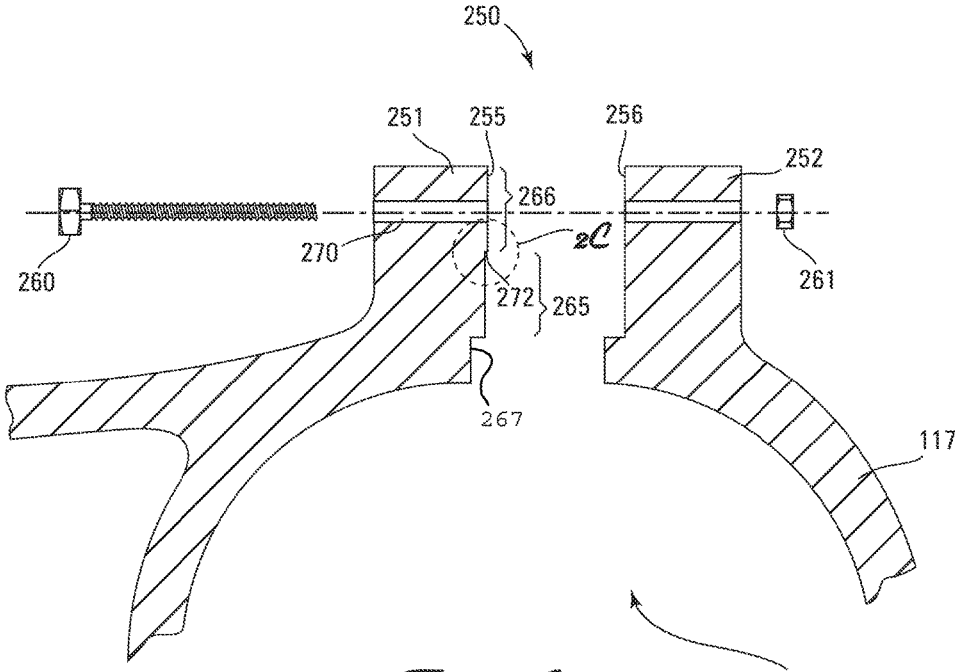
FIGS. 2A to 2D illustrate one embodiment of a sealing joint of a chiller system.

FIG. 2A illustrates a sectional view of the chiller 100 along the line A-A in FIG. 1 to illustrate a partial exploded sectional view of a sealing joint 250 of one of the casings 117 shown in FIG. 1. The sealing joint 250 includes a first cover 251 having a first mating surface 255 and a second cover 252 having a second mating surface 256. The two covers 251 and 252 are bolted together by a plurality of bolts 260 and a plurality of matching nuts 261 to form the impeller casing 117 and seal the refrigerant inside an inner cavity 269 of the casing 117. The first mating surface 255 of the first cover 251 has an inner annular portion 265 and an outer annular portion 266. The inner annular portion 265 is configured to encircle at least a portion of the inner cavity 269 of the casing 117. Generally, the second mating surface 256 is planar.

Figure 2B:
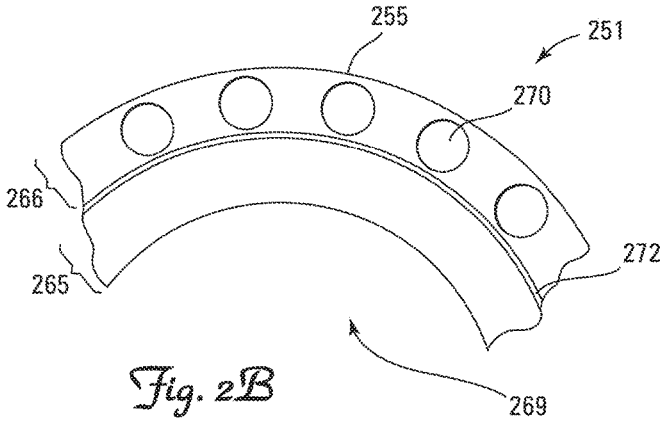

A front view of a portion of the first mating surface 255 of the first cover 251 is illustrated in FIG. 2B. From the front view, the mating surface 255 generally has a circular ring shape encircling the inner cavity 269 of the casing 117. (Only a portion of the first mating surface 255 is shown in FIG. 2B.) The first mating surface 255 has the inner annular portion 265 and the outer annular portion 266. The inner annular portion 265 is configured to encircle at least a portion of the inner cavity 269 of the casing 117 (as shown in FIG. 2A). In some embodiments, the inner annular portion 265 can be configured to encircle the entire inner cavity 269 of the casing 117. The outer annular portion 266 has a plurality of mounting holes 270 to accommodate the plurality of bolts 260 and/or the plurality of nuts 261. In some embodiments, the outer annular portion 266 can be configured to encircle the entire inner cavity 269 of the casing 117.

It is to be appreciated that the mounting holes 270, configured to accommodate the plurality of bolts 260 and/or plurality of nuts 261, may be a part of a mounting mechanism to mount the first and second covers 251 and 252 together. In some embodiments, other types of mounting mechanisms may be used. For example, the second cover 252 may include threaded holes to catch the bolts 260 so that nuts are not necessary. In some embodiments, the outer annular portion 266 can be configured to accommodate the mounting mechanism.

Figure 2C:
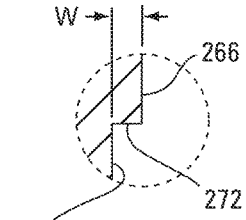

As illustrated in FIGS. 2A and 2B, the inner annular portion 265 and the outer annular portion 266 are generally planar. From the sectional view in FIG. 2A, an outline tracing from the planar surfaces of the inner annular portion 265 to the outer annular portion 266 forms a step 272. An enlarged view of the step 272 is illustrated in FIG. 2C.

The step 272 is configured to be relatively close to the mounting holes 270 of the outer annular portion 266, as illustrated in FIG. 2B. In one embodiment, the distance between an edge of the step 272 and corresponding nearest edges of the holes 270 is about 0.25 inches. Generally, a risk of separation of the surface 255 from the surface 256 (e.g., the risk of sealant failure) increases at positions further away from the holes 270. Therefore, the distance between the edges of the holes 270 and the step 272 is configured to be relatively close so as to reduce the risk of separation of the surface 255 from the surface 256. On the other hand, the step 272 is generally positioned some distance away from the holes 270 so that when the sealant is applied to the surfaces 255 and 256, some of the sealant can be disposed between the holes 270 and the step 272 to form a refrigerant tight seal. The step 272 can be configured to have a width W, as illustrated in FIG. 2C.

Figure 2D:
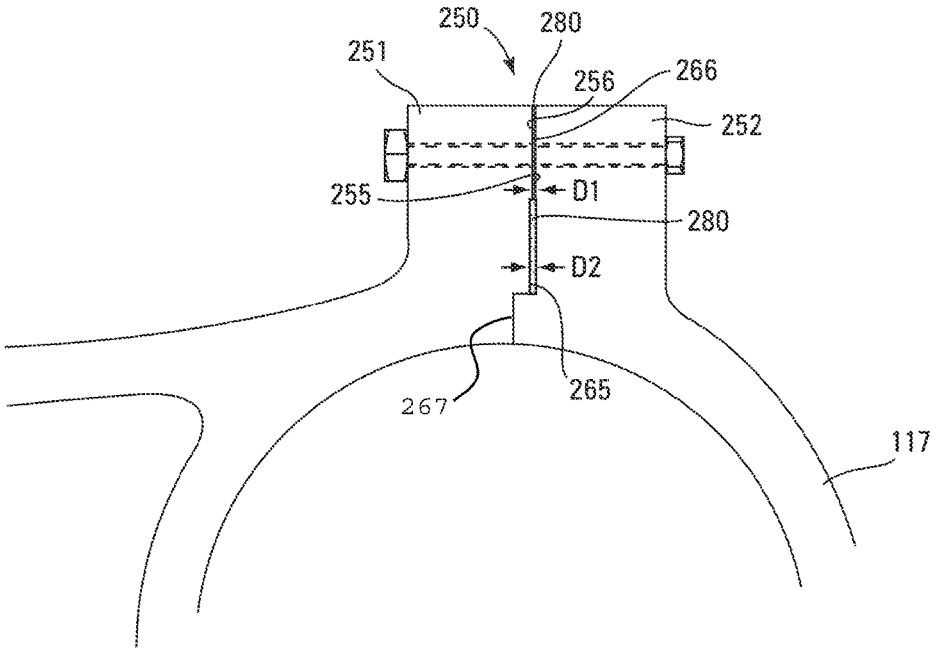

FIG. 2D illustrates a sectional view of the sealing joint 250 with a sealant applied. During installation of the sealing joint 250, a sealant 280 can be disposed onto the mating surfaces 255 and/or 256. When the first cover 251 and the second cover 252 are bolted together, the sealant 280 can be spread on the mating surfaces 255 and 256, forming a sealant layer that separates the mating surfaces 255 and 256. Because of the step 272, a distance between the outer annular portion 266 and the second mating surface 256 is less than a distance between the inner annular portion 265 and the second mating surface 256. Generally, a depth D2 of the sealant layer 280 between the inner annular portion 265 and the second mating surface 256 is deeper than a depth D1 of the sealant layer 280 between the outer annular portion 266 and the second mating surface 256. Generally, the depth D2=D1+W (as shown in FIG. 2C).

In operation, the casing 117 is subject to a pressure due to compression of the refrigerant or due to other applications such as pressure proof testing. The pressure can push the first cover 251 and the second cover 252 apart so as to push the first mating surface 255 away from the second mating surface 256. The sealant 280 therefore is subject to elongation. The sealant 280 may have some flexibility. However, if the elongation of the sealant 280 exceeds a tolerable elongation range, the sealant may fail. The tolerable elongation range of the sealant 280 can be expressed as a percentage of the depth of the sealant layer 280. For example, for a Loctite® sealant, the tolerable elongation range of the sealant is about 20% of the depth of the sealant. If such a sealant is applied to the illustrated embodiment, the sealant layer 280 between the inner annular portion 265 and the second mating surface 256 may fail if the elongation of the sealant layer 280 exceeds about 20% of D2. However, since D2=D1+W, the sealant layer 280 between the inner annular portion 265 and the second mating surface 256 can tolerate more elongation than the sealant layer 280 between the outer annular portion 266 and the second mating surface 256.

The width W can be configured so that the tolerable elongation range of the sealant layer 280 of the depth D2 (D2=D1+W) is larger than a maximum separation that the two covers 251 and 252 are subjected to during a normal operation and/or during other applications such as pressure proof tests. This maximum separation can be determined based on the separation caused by the operation pressure and/or pressure proof tests. Thus, the sealant layer 280 in the inner annular portion 265 can help ensure effective sealing between the first cover 251 and the second cover 252 even when the casing 117 is subjected to the maximum separation.

A conventional casing of two planar mating surfaces without the step 272 generally has a sealant layer depth of D1. The sealant layer depth D1 may be generally determined by, for example, a torque of the bolt 260 and the nut 261.

Different from conventional casings, because D2 is generally larger than D1, the sealing joint 250 of the casing 117 as illustrated in FIGS. 2A to 2D can tolerate more sealant elongation than a sealing joint of the conventional casing, so that the sealant layer 280 on the inner annular portion 265 can remain effective in a broader elongation range than the conventional casing. The outer annular portion 266 can help maintain the structural strength of the sealing joint 250 compared to the conventional casing. Therefore, the first mating surface 255 with the inner annular portion 265 can help reduce a risk of sealing joint failure under a pressure without sacrificing much of the structural strength of the sealing joint 250 compared to a conventional casing.

In one particular embodiment, when installed, the Loctite® sealant between the outer annular portion 266 and the second mating surface 256 is about 0.001 inch (i.e. D1=0.001 inch). The width W for the step 272 is about 0.003 inch. Therefore, the depth D2 (=D1+W) is about 0.004 inch. The Loctite® sealant has a tolerable elongation range of 20% of the depth of the sealant layer, which is determined based on the manufacturer's recommendation. Accordingly, the casing 117 can tolerate up to 0.0008 inch of separation without the sealant layer 280 failing at the sealing joint 250. In a conventional casing, which has a sealant layer depth of about 0.001 inch, the casing may fail if the separation is more than about 0.0002 inch (20% of 0.001 inch). Thus, compared to a conventional casing, the casing 117 (and the sealant 280) can tolerate about 0.0006 inch more of separation (or sealant elongation).

Figure 3A:
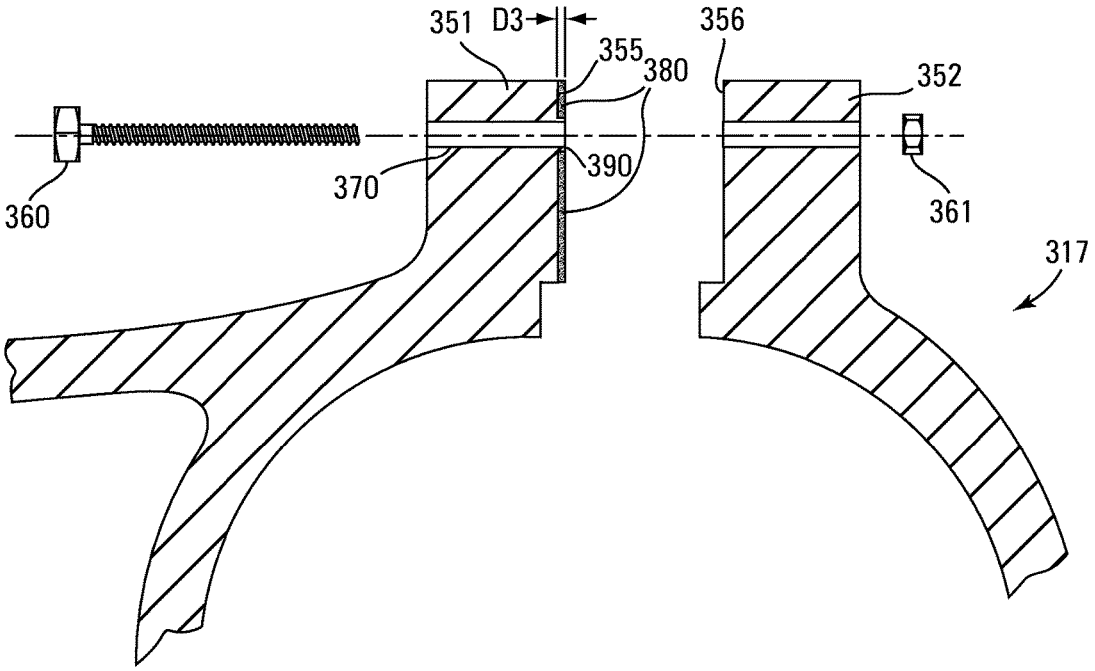
FIGS. 3A and 3B illustrate another embodiment of a sealing joint.
Figure 3B:
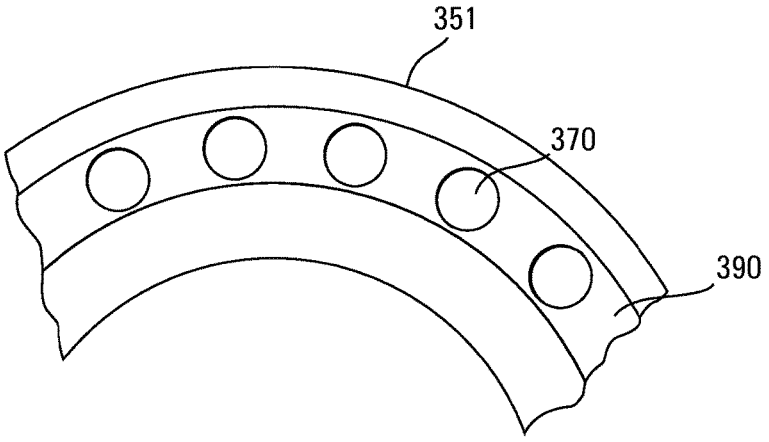

FIGS. 3A and 3B illustrate another embodiment of a casing 317. As illustrated in FIG. 3A, the casing 317 includes a first cover 351 having a first mating surface 355, and a second cover 352 having a second mating surface 356. The first mating surface 355 may be configured to have a protrusion ring 390 that rises from the mating surface 355. The protrusion ring 390 may provide a depth D3. As illustrated in FIG. 3B, the protrusion ring 390 can generally accommodate a plurality of mounting holes 370 for a plurality of bolts 360 and/or a plurality of nuts 361 (as shown in FIG. 3A).

In operation, a sealant 380 can be applied to the mating surfaces 355 and 356. Because the protrusion ring 390 provides the depth D3, the casing 317 can help increase a depth of the sealant layer 380 relative to the depth of the sealing layer between the protrusion ring 390 and the second mating surface 356.

Figure 4:
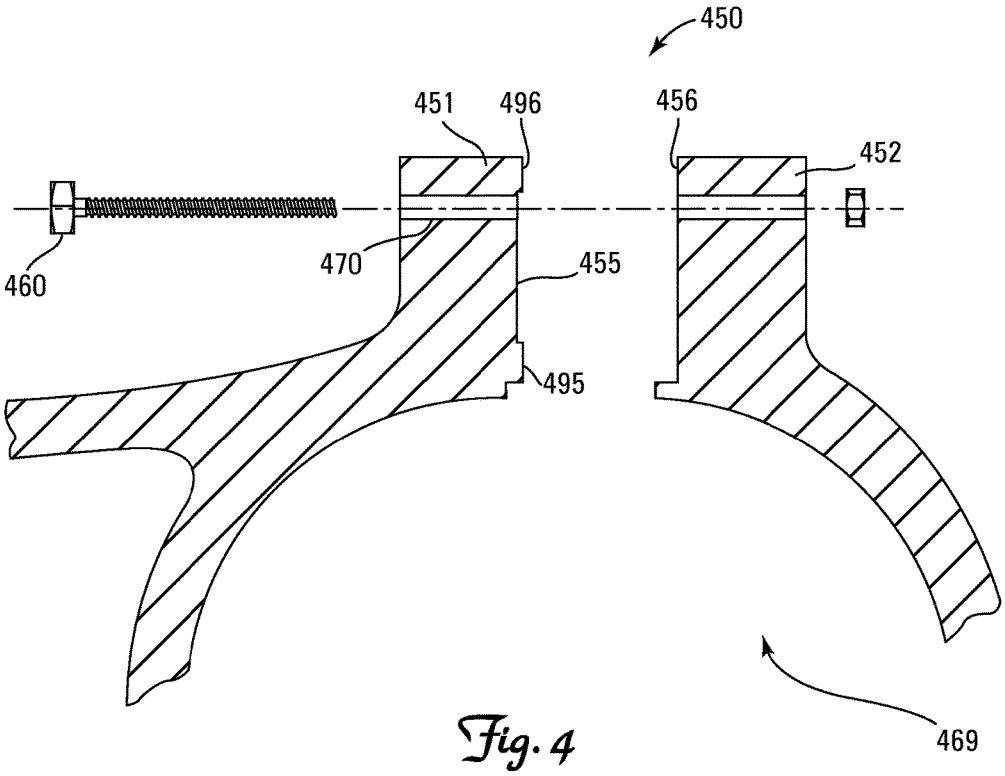
FIG. 4 illustrates yet another embodiment of a sealing joint.

FIG. 4 illustrates an exploded sectional view of another embodiment of a sealing joint 450. The sealing joint 450 includes a first cover 451 having a first mating surface 455, and a second cover 452 having a second mating surface 456. The first mating surface 455 includes at least a first protrusion ring 495 and a second protrusion ring 496, with the first protrusion ring 495 being positioned close to an inner cavity 469 of the sealing joint 450 and the second protrusion ring 496 being positioned close to an outer surface of the sealing joint 450. The first and second protrusion rings 495 and 496 may be configured to encircle the entire inner cavity 469. As illustrated, the protrusion rings 495 and 496 do not accommodate a hole 470 configured to receive a bolt 460. When a sealant is disposed on the sealing joint 450 during an installation process, the protrusion rings 495 and 496 can be pressed against the second mating surface 456, and the sealant layer disposed on mating portions of the protrusion rings 495, 496 can be pressed against the second mating surface 456 to help maintain effectiveness and/or strength of the sealing joint 450. The sealant layer disposed on the non-protrusive area of the first mating surface 455 between the first and second protrusion rings 495 and 496 can help increase a tolerable elongation range for the sealant layer, as the depth between the first and second protrusion rings 496, 496 is increased.

It is to be noted that the embodiments described here are exemplary. In the illustrated embodiments, only one mating surface is configured to have surface features, such as the step 272, third portion 267, and/or the surface protrusion(s), to increase the depth of the sealant layer on the mating surfaces. In some other embodiments, both of the mating surfaces can have surface features to increase the depth of the sealant layer.

The annular portion for the embodiments as shown in FIGS. 2A to 2D, and the protrusion ring for the embodiment as shown in FIGS. 3A and 3B are exemplary. Features other than the annular portion and the protrusion ring can also be applied. In particular, the embodiments described herein provides mating surface(s) generally configured to have a portion that maintains a minimal sealant layer depth (e.g. D1 in FIG. 2D) so as to maintain a structural strength of the sealing joint, and to have another portion that is configured to help increase a sealant layer depth so as to increase a tolerable elongation range of the sealant compared to a typical casing. The portion provided to maintain the minimal sealant thickness may be configured to accommodate a mounting mechanism, such as a plurality of bolts and nuts, to mount two covers of the sealing joint together. The portion provided to increase the sealant layer depth may include various features and shapes to help increase a sealant layer depth compared to a typical casing. In some embodiments, the portion provided to increase the sealant layer depth may be configured to be positioned between an inner cavity (e.g. 269 in FIG. 2A) and the portion used to maintain a minimal sealant thickness. In some embodiments, these two portions can be configured to encircle an entire inner cavity of the casing. In some other embodiments, one or both of the two portions can be configured to encircle only a portion of the inner cavity of the casing.

It is to be appreciated that different sealants may have different tolerable elongation ranges. The tolerance range may generally be specified by manufacturers. Depending on the sealant applied, the width of the step (e.g. the width W of the step 272 in FIG. 2C) or the height of the ring (e.g. the depth D3 of the protrusion ring 390 in FIG. 3B) may be changed to match different sealant tolerable elongation ranges. The embodiments discloses herein may also be adapted for use in other sealing joints, such as an oil tank casing. Generally, the embodiments disclosed herein may be adapted for use in a sealing joint using a sealant, and where the sealing joint may be subject to separation during operation which may cause elongation of the sealant leading to a sealing failure.

Any aspects 1-6 can be combined with any aspects 7-14. Any aspects 7-9 can be combined with any aspects 10-14. Any aspects 10-12 can be combined with any aspects 13-14.

Aspect 1. A sealing joint for a compressor casing comprising:

a mating surface having a first portion and a second portion; and an inner cavity;

wherein the second portion is positioned between the inner cavity and the first portion, and the first portion and the second portion define a step therebetween.

Aspect 2. The sealing joint of aspect 1, wherein the first portion and the second portion are configured to receive a sealant.

Aspect 3. The sealing joint of aspects 1-2, wherein the first portion and the second portion are configured to encircle the entire inner cavity of the sealing joint.

Aspect 4. The sealing joint of aspects 1-3, further comprising:

a second mating surface;

wherein the second mating surface is configured to mate with the first portion and the second portion, when a sealant is applied between the mating surface and the second mating surface, a depth of the sealant on the second portion is deeper than a depth of the sealant on the first portion.

Aspect 5. The sealing joint of aspect 4, wherein the second mating surface is planar.

Aspect 6. The sealing joint of aspects 1-5, wherein the first portion of the mating surface has a hole to accommodate a mounting mechanism.

Aspect 7. A sealing joint of a compressor casing comprising:

a first mating surface and a second mating surface, the first mating surface has a first portion and a second portion;

an inner cavity; and a sealant disposed between the first mating surface and a second mating surface;

wherein the second portion is positioned between the inner cavity of the sealing joint and the first portion, and a distance between the first portion to the second mating surface is smaller than a distance between the second portion to the second mating surface.

Aspect 8. The sealing joint of aspect 7, wherein the first mating surface and the second mating surface are configured such that when they are subjected to a maximum separation, and where the sealant has a recommended elongation range relative to a depth of the sealant on the second portion of the first mating surface, the maximum separation is less than the recommended elongation range.

Aspect 9. The sealing joint of aspects 7-8, wherein the first portion and the second portion are configured to encircle the entire inner cavity of the sealing joint.

Aspect 10. A sealing joint of a compressor casing, comprising:

a first mating surface including a first portion and a second portion;

a second mating surface; and a sealant disposed between the first mating surface and the second mating surface;

wherein a depth of the sealant between the first portion and the second mating surface is different from a depth of the sealant between the second portion and the second mating surface.

Aspect 11. The sealing joint of aspect 10, further comprising:

an inner cavity;

wherein the second portion is configured to surround the inner cavity, and the depth of the sealant between the first portion and the second mating surface is smaller than the depth of the sealant between the second portion and the second mating surface.

Aspect 12. The sealing joint of aspects 10-11, further comprising:

an inner cavity;

wherein the first portion is a raised protrusion of the first mating surface.

Aspect 13. A method to increase a reliability of a sealing joint of a compressor casing, comprising:

applying a sealant on a first portion of a mating surface of the sealing joint; and applying a sealant on a second portion of the mating surface of the sealing joint, wherein a depth of the sealant on the second portion of the mating surface of the sealing joint is larger than a depth of the sealant on the first portion of the mating surface.

Aspect 14. The method of aspect 13, wherein the second portion of the mating surface is positioned between an inner cavity of the sealing joint and the first portion of the mating surface.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A sealing joint for a centrifugal compressor, comprising:

an inner cavity defined inside a casing, the casing includes a first cover and a second cover, a sealing joint between the first cover and second cover, the first cover includes:

a first portion having a first surface;

a first step, the first step extends into the first cover, the first surface radially extends toward the inner cavity, the first surface extending from an external side of the first cover to the first step;

a second portion having a second surface;

a second step, the second step extends into the first cover, the second step extends farther into the first cover than the first step, the second surface radially extends toward the inner cavity, the second surface extending from the first step to the second step;

the second step defines an upper contact surface; and a third portion having a third surface, the third surface radially extends to the inner cavity, the third surface extending from the second step to the inner cavity;

the second cover includes:

a first portion having a fourth surface; and a protrusion, the fourth surface radially extends toward the inner cavity, the fourth surface extending from an external side of the second cover to the protrusion, the fourth surface is configured to mate with the first surface and the second surface of the first cover when the first and second covers are connected, the protrusion radially extends to the inner cavity, the protrusion extending from the fourth surface to the inner cavity, the protrusion extending outward toward the third surface of the first cover and outward relative to the fourth surface of the second cover, and the protrusion defines a lower contact surface;

a mounting mechanism inserted through the first surface of the first cover and the fourth surface of the second cover; and a sealant separately applied between the fourth surface of the second cover and the first and second surfaces of the first cover, wherein a depth of the sealant between the second surface and the fourth surface is larger than a depth of the sealant between the first surface and the fourth surface, wherein the upper contact surface of the second step and the lower contact surface of the protrusion are in direct contact, and when the first cover and the second cover are connected, the sealant is disposed on the lower contact surface of the protrusion, and a layer of the sealant is maintained between the first cover and the second cover, such that the sealant radially extends along the first surface and the second surface of the first cover, extending from the external side of the first cover to the second step, and such that the sealant radially extends along the fourth surface of the second cover, extending from the external side of the second cover to the protrusion.

2. The sealing joint of claim 1, wherein the first cover includes a protrusion ring positioned in proximity to the second surface, and a second protrusion ring positioned in proximity to the third surface, and wherein the first and second protrusion rings increase a tolerable elongation range for the sealant.

3. The sealing joint of claim 1, wherein the third surface and the protrusion are configured to entirely encircle the inner cavity of the sealing joint.

4. The sealing joint of claim 1, wherein the fourth surface is planar.

5. The sealing joint of claim 1, wherein the casing is an impeller casing.

6. The sealing joint of claim 1, wherein the mounting mechanism comprises a bolt, wherein the bolt is disposed through the first surface of the first cover and the fourth surface of the second cover and connected to a nut.

7. A sealing joint of a compressor casing, comprising:

an inner cavity defined inside the compressor casing, the casing includes a first and second cover; and a sealing joint between the first cover and second cover, the first cover includes:

a first portion having a first surface;

a first step, the first step extends into the first cover, the first surface radially extends toward the inner cavity, the first surface extending from an external side of the first cover to the first step;

a second portion having a second surface;

a second step, the second step extends into the first cover, the second step extends farther into the first cover than the first step, the second surface radially extends toward the inner cavity, the second surface extending from the first step to the second step;

the second step defines an upper contact surface; and a third portion having a third surface, the third surface radially extends to the inner cavity, the third surface extending from the second step to the inner cavity;

the second cover includes:

a first portion having a fourth surface; and a protrusion, the fourth surface radially extends toward the inner cavity, the fourth surface extending from an external side of the second cover to the protrusion, the fourth surface is configured to mate with the first surface and the second surface of the first cover when the first and second covers are connected, the protrusion radially extends to the inner cavity, the protrusion extending from the fourth surface to the inner cavity, the protrusion extending outward toward the third surface of the first cover and outward relative to the fourth surface of the second cover, and the protrusion defines a lower contact surface;

the first cover and the second cover include a mounting mechanism inserted through the first surface of the first cover and the fourth surface of the second cover, a sealant separately disposed between the first surface and the second surface of the first cover and the fourth surface of the second cover, wherein a depth of the sealant between the second surface and the fourth surface is larger than a depth of the sealant between the first surface and the fourth surface;

wherein the upper contact surface of the second step and the lower contact surface of the protrusion are in direct contact, and when the first cover and second cover are connected, the sealant is disposed on the lower contact surface of the protrusion, and a layer of the sealant is maintained between the first cover and the second cover, such that the sealant radially extends along the first surface and the second surface of the first cover, extending from the external side of the first cover to the second step, and such that the sealant radially extends along the fourth surface of the second cover, extending from the external side of the second cover to the protrusion.

8. The sealing joint of claim 7, wherein the first surface, the second surface, and the fourth surface are configured such that when they are subjected to a maximum separation, and where the sealant has a recommended elongation range relative to the depth of the sealant between the second surface and the fourth surface, the maximum separation is less than the recommended elongation range.

9. The sealing joint of claim 7, wherein the third surface and the protrusion are configured to entirely encircle the inner cavity of the sealing joint, wherein the inner cavity contains compressed refrigerant.

10. The sealing joint of claim 7, wherein the mounting mechanism comprises a bolt, wherein the bolt is disposed through the first surface of the first cover and the fourth surface of the second cover and connected to a nut.

11. A method to increase a reliability of a sealing joint of a compressor casing, comprising:

defining an inner cavity inside a casing, the casing including a first cover and a second cover; and applying a sealant between the first cover and the second cover, the first cover including:

a first portion having a first surface, a first step, the first step extends into the first cover, the first surface radially extends toward the inner cavity, the first surface extending from an external side of the first cover to the first step;

a second portion having second surface, a second step, the second step extends into the first cover, the second step extending farther into the first cover than the first step, the second surface radially extends toward the inner cavity, the second surface extending from the first step to the second step;

the second step defines an upper contact surface; and a third portion having a third surface, the third surface radially extends to the inner cavity, the third surface extending from the second step to the inner cavity;

the second cover includes:

a first portion having a fourth surface; and the fourth surface radially extends toward the inner cavity, the fourth surface extending from an external side of the second cover to the protrusion, the fourth surface is configured to mate with the first surface and the second surface of the first cover when the first and second covers are connected, the protrusion radially extends to the inner cavity, the protrusion extending from the fourth surface to the inner cavity, the protrusion extending outward toward the third surface of the first cover and outward relative to the fourth surface of the second cover, and the protrusion defines a lower contact surface;

sealing the first surface, the second surface, and the fourth surface, wherein a depth of the sealant between the second surface and the fourth surface is larger than a depth of the sealant between the first surface and the fourth surface of the second cover, wherein the upper contact surface of the second step and lower contact surface of the protrusion are in direct contact, and when the first cover and the second cover are connected, the sealant is disposed on the lower contact surface of the protrusion, and a layer of the sealant is maintained between the first cover and the second cover, such that the sealant radially extends along the first surface and the second surface of the first cover, extending from the external side of the first cover to the second step, and such that the sealant radially extends along the fourth surface of the second cover, extending from the external side of the second cover to the protrusion; and inserting a mounting mechanism through the first surface of the first cover and the fourth surface of the second cover.

* * * * *